US008475267B1

(12) United States Patent
Brook et al.

(10) Patent No.: US 8,475,267 B1
(45) Date of Patent: Jul. 2, 2013

(54) SYSTEMS, DEVICES AND METHODS FOR ELECTRONIC SPORTS BOOK WAGERING WITH A WAGER SELL BACK OPTION

(71) Applicants: Richard M. Brook, Austin, TX (US); Michael P. Brook, Puyallup, WA (US)

(72) Inventors: Richard M. Brook, Austin, TX (US); Michael P. Brook, Puyallup, WA (US)

( * ) Notice: Subject to any disclaimer, the term of this patent is extended or adjusted under 35 U.S.C. 154(b) by 0 days.

(21) Appl. No.: 13/764,557

(22) Filed: Feb. 11, 2013

Related U.S. Application Data

(63) Continuation of application No. 13/413,431, filed on Mar. 6, 2012, now Pat. No. 8,398,483.

(51) Int. Cl.
*A63F 9/24* (2006.01)

(52) U.S. Cl.
USPC ..... 463/25; 463/42

(58) Field of Classification Search
USPC ..... 463/16, 25–26, 42
See application file for complete search history.

(56) References Cited

U.S. PATENT DOCUMENTS

| | | | | |
|---|---|---|---|---|
| 5,769,714 | A | 6/1998 | Wiener et al. | |
| 6,007,427 | A | 12/1999 | Wiener et al. | |
| 7,294,054 | B2 | 11/2007 | Schugar et al. | |
| 7,909,694 | B2 | 3/2011 | Schugar | |
| 2004/0248637 | A1 | 12/2004 | Liebenberg et al. | |
| 2006/0025208 | A1 | 2/2006 | Ramsey | |
| 2006/0040725 | A1* | 2/2006 | Walker et al. | 463/16 |
| 2006/0199631 | A1 | 9/2006 | McGill et al. | |
| 2006/0252511 | A1 | 11/2006 | Walker et al. | |
| 2006/0259380 | A1* | 11/2006 | Milstein et al. | 705/35 |
| 2007/0192234 | A1 | 8/2007 | Sireau | |
| 2008/0039189 | A1 | 2/2008 | Walker et al. | |
| 2008/0081685 | A1* | 4/2008 | Naftaly | 463/16 |
| 2008/0090632 | A1 | 4/2008 | Kumar | |
| 2008/0248850 | A1 | 10/2008 | Schugar | |
| 2008/0311981 | A1 | 12/2008 | Schugar | |
| 2009/0203448 | A1 | 8/2009 | Lupo et al. | |
| 2011/0117982 | A1 | 5/2011 | Nguyen | |
| 2011/0183737 | A1 | 7/2011 | Suttle | |

OTHER PUBLICATIONS

Sportsbettingsites.org, BetOnline Review, Nov. 26, 2011, http://sportsbettingsites.org/betonline/.*
"BetOnline Review—Offers, History, Concerns and Rating," http://sportsbettingsites.org/betonline, Nov. 26, 2011, 5 pages.
Examination Opinion of GB 1208671.6 dated Sep. 5, 2012, 3 pages.

* cited by examiner

*Primary Examiner* — Dmitry Suhol
*Assistant Examiner* — Jason Yen
(74) *Attorney, Agent, or Firm* — Seed IP Law Group PLLC

(57) ABSTRACT

An electronic sports book wagering system provides a bettor with an opportunity to purchase a sports book ticket sell back option when placing a bet on the outcome of an event. An option may be purchased by a bettor to be exercised at will by the bettor during a break in play or during an indicated period of the event for the bettor to potentially receive compensation to cancel the wager (e.g., at half time during a football game on which the wager was placed). The amount of compensation or refund provided to the bettor upon exercise of the option may be determined based on a current probability at the break in play or indicated period of whether the bettor will win the bet for which the wager was made. The bettor may be guaranteed a minimum refund amount of the original wager upon exercising the option.

18 Claims, 8 Drawing Sheets

SYSTEMS, DEVICES AND METHODS FOR ELECTRONIC SPORTS BOOK WAGERING WITH A WAGER SELL BACK OPTION

BACKGROUND

1. Field

This disclosure generally relates to wagering systems, and particularly to electronic sports book wagering.

2. Description of the Related Art

An organization, company, institution or other entity that accepts bets or places wagers for bettors on the general outcome of events (e.g., on scores or other attributes of sporting events) is referred to as a sports book. The role of the sports book is to act as a market maker for sports wagers. The sports book accepts wagers placed on either team or competitor, and maintains a point spread which aims to ensure a profit (i.e., the vigorish) for the sports book regardless of the outcome of the wager by attempting to attract an equal dollar amount of wagers for each team or competitor of a particular event. Sports books in general are continually striving to improve profits while maintaining current bettors' interest and attracting new bettors.

BRIEF SUMMARY

A method of operating an electronic sports book wagering system including at least one processor and at least one non-transitory computer-readable medium coupled to the at least one processor may be summarized as including: receiving, by the at least one processor, a request to place a wager of a bettor for a bet regarding an outcome of an event; receiving an indication, by the at least one processor, of whether the bettor has selected to purchase an option to be exercised at will by the bettor during a break in play or indicated period for the bettor to potentially receive compensation to cancel the wager; and if the received indication indicates the bettor has selected to purchase the option, calculating, by the at least one processor, an option fee to charge the bettor for the purchase of the option.

The received indication may indicate the bettor has selected to purchase the option and may further include: receiving an indication that the bettor has placed the wager; receiving an indication that the bettor has paid the option fee; and recording the wager and associating the wager with the purchased option. The method may further include issuing a ticket to the bettor indicative of the wager associated with the purchased option. The ticket to the bettor indicative of the wager associated with the purchased option may also include an indication of a determined current amount to refund to the bettor should the bettor exercise the purchased option. The ticket may be an electronic ticket. The method may further include issuing a ticket to the bettor indicative of the wager after receiving the indication that the bettor has placed the wager and then performing the recording of the wager and the associating the wager with the purchased option. The associating the wager with the purchased option may occur at some elapsed time from the recording of the wager and to before completion of the break in play or to before completion of the indicated period. The method may further include during the break in play or the indicated period, receiving an indication that the bettor is exercising the purchased option; in response to the received indication that the bettor is exercising the purchased option, determining an amount to refund to the bettor; initiating a disbursement of the amount to refund to the bettor; and canceling the wager. An amount to refund to the bettor may be based on a current percentage probability at the break in play or the indicated period of whether the bettor will win the bet for which the wager was made. An amount to refund to the bettor may be based on incentivizing exercising of all respective individual options purchased by respective bettors to be exercised at will by the respective bettors during the break in play or the indicated period. The determining the amount to refund to the bettor may include: determining a current probability at the break in play or indicated period of whether the bettor will win the bet for which the wager was made; subtracting a determined amount from a number reflecting the current probability to obtain a multiplier; to obtain a bettor refund amount factor, multiplying the multiplier by an amount that would be paid to the bettor if the bettor were to win the bet; and subtracting a determined amount from the bettor refund amount factor to determine the amount to refund to the bettor. The determined amount to refund to the bettor may be the refund amount factor less any associated fees. The determining the amount to refund to the bettor may be based on a minimum refund amount guaranteed at a time when the purchased option was purchased, should the bettor choose to exercise the purchased option. The minimum refund amount guaranteed may be a percentage of the wager. The determining a current probability at the break in play or indicated period of whether the bettor will win the bet for which the wager was made may include determining the probability based on historical data regarding outcomes of previous events of a same type as the event. The historical data may include data based on at least one of: same team scores, same score spread, and same home and away team combination taking into account a current score at a corresponding break in play or corresponding interval of the indicated period in previous events.

An electronic sports book wagering system may be summarized as including: at least one processor; at least one processor-readable memory that stores instructions executable by the at least one processor to cause the at least one processor to: receive an indication that a bettor has placed a wager for a bet regarding an outcome of an event; receive an indication that the bettor has selected an option to be exercised at will by the bettor during a break in play or an indicated period for the bettor to potentially receive compensation to cancel the wager; and generate a ticket for the bettor indicative of the wager associated with the purchased option.

The break in play may be one of: a half time period, a quarter period, a period between innings or half-innings in a baseball game, a time-out, a period between regulation time and an overtime period, a period during caution laps of an auto race, a period intermission of a hockey game, a period between rounds of a boxing match, a period prior to specific types of plays, a period prior to a specific event that potentially could occur during a course of play, including one or more of: an injury to a player, removal of a pitcher and changing of a goaltender. The indicated period may be an elapsed time from a moment the wager is placed through a completion of one of: a portion of the event and the entirety of the event. The at least one processor-readable memory may store instructions executable by the at least one processor to further cause the at least one processor to: during the break in play or the indicated period, receive an indication that the bettor is exercising the purchased option; in response to the received indication that the bettor is exercising the purchased option, determine an amount to refund to the bettor; initiate a disbursement of the amount to refund to the bettor; and cancel the wager. The determination of the amount to refund to the bettor may be influenced by a current number of options exercised by other bettors during or prior to the break in play or indicated period. The instructions executable by the at least one processor may cause the at least one processor to: determine a current probability at the specified break in play or indicated period of whether the bettor will win the bet for which the wager was made; multiply the determined current probability by an amount that would be paid to the bettor if the bettor were to win the bet to obtain a bettor refund amount factor; and determine the amount to refund to the bettor based on the bettor refund amount factor.

A non-transitory computer-readable medium stores instructions that, when executed by at least one computer system, may cause the at least one computer system to: receive, during a break in play or an indicated period, an indication that a bettor is exercising an option for the bettor to potentially receive compensation to cancel a wager previously placed by the bettor on an outcome of the event; in response to the received indication that the bettor is exercising the option, determine an amount to refund to the bettor; initiate a disbursement of the amount to refund to the bettor; and cancel the wager.

The instructions may further cause the at least one computer system to: determine a current probability at the break in play or indicated period of whether the bettor will win the bet for which the wager was made; subtract a determined amount from the current probability to obtain a multiplier; multiple the multiplier by an amount that would be paid to the bettor if the bettor were to win the bet to obtain a bettor refund amount factor; and subtract a determined amount from the bettor refund amount factor to determine the amount to refund to the bettor. The instructions may cause the at least one computer system to electronically initiate provision of a refund voucher in order to initiate the disbursement of the amount to refund to the bettor. The refund voucher may be an electronic voucher. The instructions may cause the at least one computer system to indicate to the bettor how the bettor may obtain the amount to refund to the bettor.

A method may be summarized as including: determining that a bettor has selected an option to be exercised at will by the bettor during a break in play or an indicated period during an event, the option being for the bettor to potentially receive compensation to cancel a wager placed on the event; receiving an indication that the bettor intends to exercise the option; and calculating, by at least one processor of a sports book wagering system, an amount to refund to the bettor based on the receiving the indication that the bettor intends to exercise the option.

The method may further include determining an option fee to charge the bettor for selection of the option. The option fee may be in the range from 0% to 99% of an amount of the wager. The option fee may be one or a combination of the following: a flat fee and a percentage of the wager. The method may further include communicating a minimum determined amount to refund to the bettor at a time of selection by the bettor of the option. The method may further include varying the determined amount to refund to the bettor. The method may further include communicating the varied determined amount to the bettor in response to the varying of the determined amount. The method may further include communicating the determined amount to the bettor at any time from a moment the wager is placed through completion of the break in play or through completion of the indicated period. The receiving an indication that a bettor intends to exercise the option may include receiving the indication that the bettor intends to exercise the purchased option during the break in play or during the indicated period. The method may further include communicating the determined amount to the bettor in response to the received indication that the bettor intends to exercise the purchased option. The calculated amount to refund to the bettor may be based on a current probability at the break in play or indicated period of whether the bettor will win the bet for which the wager was made. The calculating an amount to refund to the bettor may include determining a probability of whether the bettor will win the bet for which the wager was made based on historical data regarding outcomes of previous events. The receiving an indication that the bettor intends to exercise the option may include receiving the indication via at least one of: a server computing system, a sports book agent, and a bettor handheld device. The determining that a bettor has selected an option may include receiving an indication that the bettor has selected the option via at least one of: a server computing system, a sports book agent, and a bettor handheld device. The method may further include receiving an indication that the bettor has placed the wager via at least one of: a server computing system, a sports book agent, and a bettor handheld device.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with computing systems including client and server computing systems, as well as networks have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments.

Figure 1:
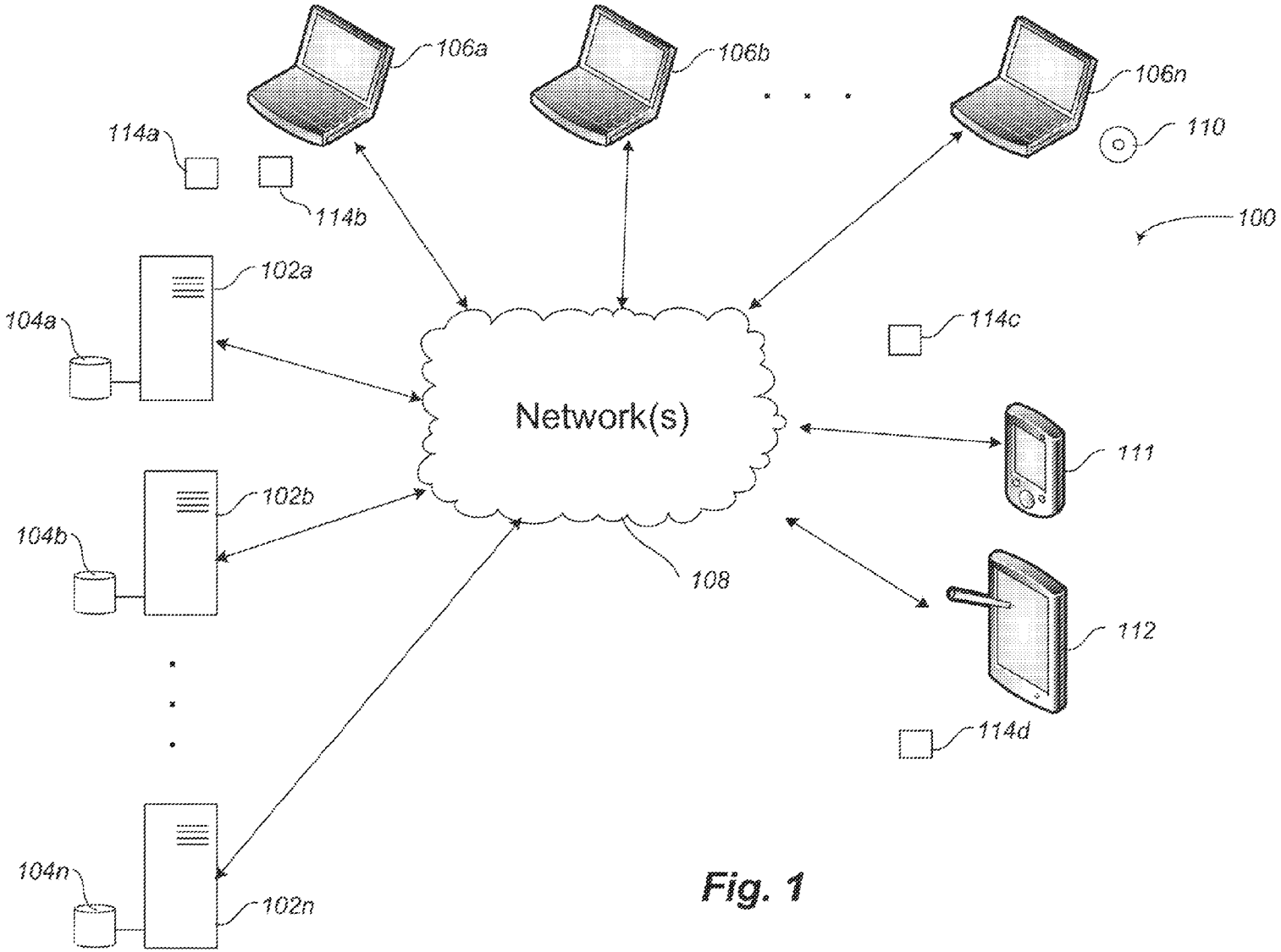
FIG. 1 is a schematic diagram of a networked environment, including a number of servers and a number of clients communicatively coupled to the servers by one or more networks, of which systems, devices and methods for electronic sports book wagering may be a part, or in which they may be implemented, according to one illustrated embodiment.

FIG. 1 shows a networked environment 100, including a number of servers and a number of clients communicatively coupled to the servers by one or more networks, of which systems, devices and methods for electronic sports book wagering may be a part, or in which they may be implemented, according to one illustrated embodiment.

The network environment 100 includes a number of server computing systems 102*a*-102*n* (collectively 102). The server computing systems 102 include processors that execute server instructions (i.e., server software) stored on computer-readable storage media to provide server functions in the network environment 100. For example, the server computing systems 102 may electronically generate, place, execute and/or track sports book wagers and sports book ticket sell back options and related transactions; determine refund amounts for exercising sports book ticket sell back options; and/or receive input regarding indications of sports book wagers and sports book ticket sell back options and related transactions stored in one or more databases or other computer-readable storage media 104*a*-104*n* (collectively 104). The term sports book used herein means any service related to placing wagers or tracking wagers placed on the outcomes of or otherwise related to sporting events, such as football, basketball, baseball, soccer, or any other sporting event, game or match, horse racing, political events, competitions, contests, activities of public figures, activities of celebrities, etc., including any public event on which the sports book offers opportunities to bet.

The network environment 100 includes a number of client computing systems 106*a*-106*n* (collectively 106) selectively communicatively coupled to one or more of the server computing systems 102 via one or more communications networks 108. The client computing systems 106 include one or more processors that execute one or more sets of communications instructions stored on any of a variety of non-transitory computer-readable storage media 110 (only one illustrated in FIG. 1). The client computing systems 106 may take a variety of forms, for instance desktop, laptop or notebook personal computers, tablet computers, workstations, mini-computers, mainframe computers, or other computational devices with microprocessors or microcontrollers which are capable of networked communications. The client computing systems 106 may be communicatively coupled to the rest of the network 108 via wired, wireless or a combination of wired and wireless communications channels.

The network environment 100 includes a number of telecommunications devices 111 (only one illustrated). Such telecommunications devices 111 may, for example, take the form of Internet or Web enabled cellular phones (e.g., iPHONE®). The network environment 100 also includes a number of personal digital assistant (PDA) devices 112 (only one illustrated). Such PDA devices 112 may, for example, take the form of Internet or Web enabled PDAs or tablet computers (e.g., iPHONE®, iPAD®, TREO®, BLACKBERRY®), which may, for example, execute a set of browser instructions or program. The network environment 100 may include any number of a large variety of other devices that are capable of some type of networked communications. The telecommunications devices 110, PDA devices 112, as well as any other devices, may be communicatively coupled to the rest of the network 108 via wired, wireless or a combination of wired and wireless communications channels.

The one or more communications networks 108 may take a variety of forms. For instance, the communications networks 108 may include wired, wireless, optical, or a combination of wired, wireless and/or optical communications links. The one or more communications networks 108 may include public networks, private networks, unsecured networks, secured networks or combinations thereof. The one or more communications networks 108 may employ any one or more communications protocols, for example TCP/IP protocol, UDP protocols, IEEE 802.11 protocol, as well as other telecommunications or computer networking protocols. The one or more communications networks 108 may include what are traditionally referred to as computing networks and/or what are traditionally referred to as telecommunications networks or combinations thereof. In at least one embodiment, the one or more communications networks 108 includes the Internet, and in particular, the Worldwide Web (referred to herein as "the Web"). Consequently, in at least one embodiment, one or more of the server computing systems 102 execute server software to serve HTML source files or Web pages 114*a*-114*d* (collectively 114), and one or more client computing systems 106, telecommunications devices 110 and/or PDAs 112 execute browser software to request and display HTML source files or Web pages 114.

The network environment 100 includes an interactive system for electronically generating, placing, executing and/or tracking sports book wagers and sports book ticket sell back options and related transactions; determining refund amounts for bettors exercising sports book ticket sell back options; and/or receiving input regarding indications of sports book wagers and sports book ticket sell back options and related transactions. The interactive system may include one or more server computing systems 102, databases 104 and one or more client systems 106, telecommunications devices 111, and/or PDA devices 112.

The one or more server computing systems 102 execute instructions stored on non-transitory computer-readable storage media that cause the server computing systems 102 to electronically generate, place, execute and/or track sports book wagers and sports book ticket sell back options, and determine and issue refund amounts with respect to and/or between one or more client systems 106, telecommunications devices 111, and/or PDA devices 112, and provide communications during or in connection with such services to and between one or more client systems 106, telecommunications devices 111, and/or PDA devices 112.

Although not required, the embodiments will be described in the general context of computer-executable instructions, such as program application engines, objects, or macros stored on computer- or processor-readable storage media and executed by a computer or processor. Those skilled in the relevant art will appreciate that the illustrated embodiments as well as other embodiments can be practiced with other affiliated system configurations and/or other computing system configurations, including hand-held devices, multiprocessor systems, microprocessor-based or programmable consumer electronics, personal computers ("PCs"), network PCs, mini-computers, mainframe computers, and the like. The embodiments can be practiced in distributed computing environments where tasks or acts are performed by remote processing devices, which are linked through a communications network. In a distributed computing environment, program engines may be located in both local and remote memory storage devices.

Figure 2:
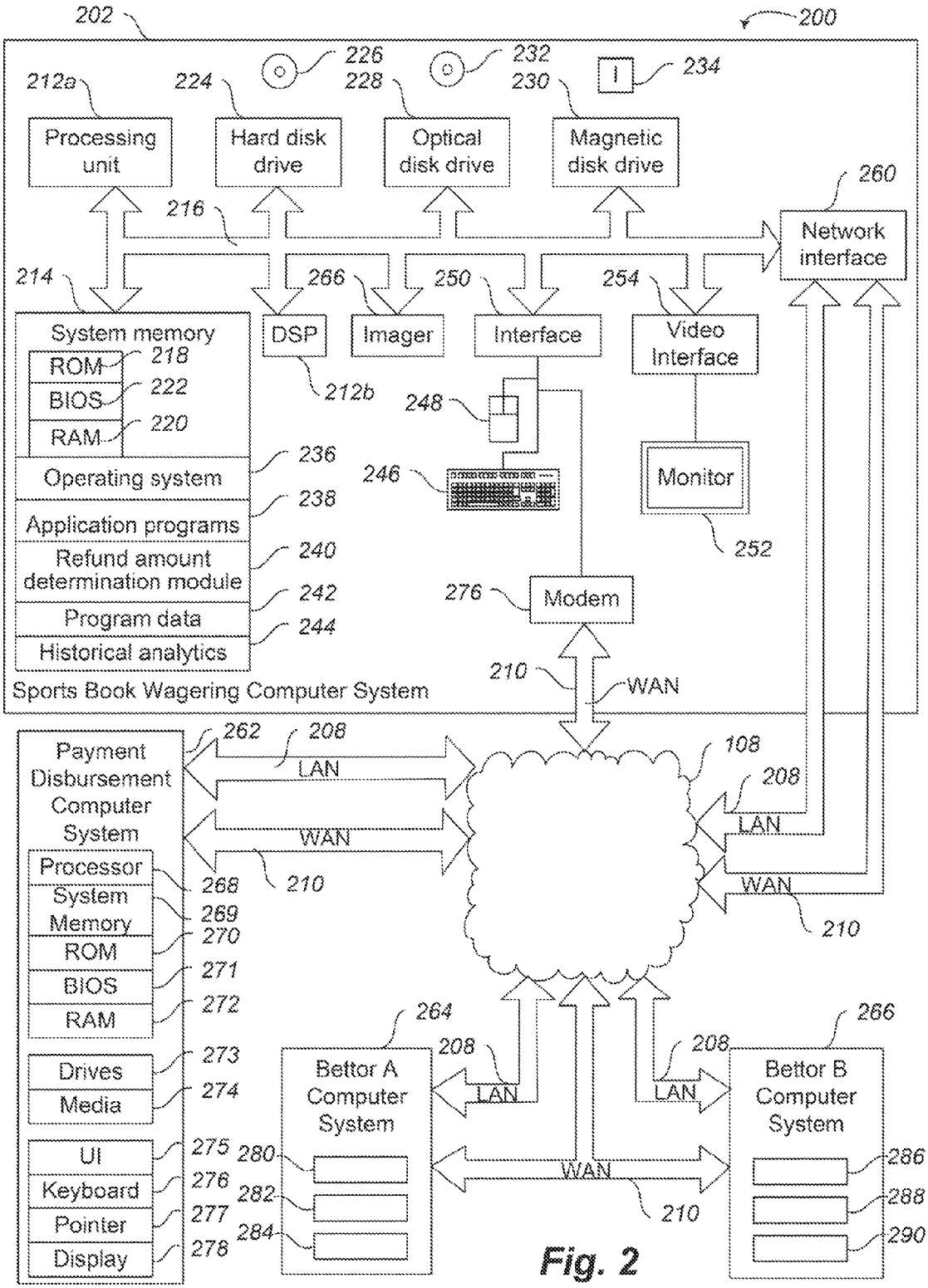
FIG. 2 is a schematic diagram of an electronic sports book wagering environment having example bettor computing systems, an example sports book wagering computer system, and an example payment disbursement computer system, according to one illustrated embodiment.

FIG. 2 shows an electronic sports book wagering environment 200 comprising a sports book wagering computer system 202, a payment disbursement computer system 262, example Bettor A computer system 264 and example Bettor B computer system 266, communicatively coupled by one or more communications channels, for example one or more local area networks (LANs) 208 or wide area networks (WANs) 210 that may be part of or connect to network 108. For example, the server computing systems 102 of FIG. 1 may include the sports book wagering computer system 202 and/or the payment disbursement computer system 262. Likewise, the number of client computing systems 106*a*-106*n* (collectively 106), telecommunications devices 111, and/or PDA devices 112 of FIG. 1 may include the example Bettor A computer system 264 and example Bettor B computer system 266. Communication between the computer systems shown in FIG. 2 may also be by transferring data on a non-transitory computer-readable medium, such as a disk, flash drive, other memory device, etc., that is readable by such computer systems.

The payment disbursement computer system 262 may include those computer systems of one or more various sports book entities of a casino or other licensed sports betting establishment. The example Bettor A computer system 264 and example Bettor B computer system 266 may include any user computer system having a Web browser on which Web sites, Web pages and/or Web applications are displayed or other sports book wagering or betting applications, such as those provided by a sports book of a casino or other licensed sports betting establishment, etc. Such Web sites, Web pages and/or Web applications may include those hosted and/or served by sports book wagering computer system 262, or those hosted and/or served by a Web server computer system accessible by the sports book wagering computer system 262, example Bettor A computer system 264, and example Bettor B computer system 266. For example, such a Web server computer system may be one or more of the server computing systems 102 of FIG. 1.

Sports book wagering computer system 202 may include those computer systems that electronically generate, place, execute and/or track sports book wagers and sports book ticket sell back options and related transactions; determine refund amounts for exercising sports book ticket sell back options; and/or receive input regarding indications of sports book wagers and sports book ticket sell back options and related transactions, stored in one or more databases or other computer-readable storage media. Sports book wagers may include wagers on any public event on which the sports book offers opportunities to bet, including, but not limited to: sporting events, horse racing, political events, competitions, contests, activities of public figures, activities of celebrities, etc. An "event" or a "sporting event" as used herein means any public event on which a sports book offers opportunities to bet. The sports book wagering computer system 202 may also provide a user interface to accept wagers from and sell sports book ticket sell back options to example Bettor A via example Bettor A computer system 264 and example Bettor B via example Bettor B computer system 266. For example, the user interface may be displayed as, within, or on Web pages served by the sports book wagering computer system 202, or as interfaces of other applications, including those various Web pages and Web sites of sports book operations, organizations, companies and individuals hosted and/or served by another Web server computer system or other computer system accessible via one or more local area networks (LANs) 208 or wide area networks (WANs) 210 that may be part of network 108.

The sports book wagering computer system 202 will at times be referred to in the singular herein, but this is not intended to limit the embodiments to a single device since, in typical embodiments, there may be more than one sports book wagering computer system or devices involved, or there may be multiple different computing systems that each store and/or serve different items (e.g., a Web server separate from a sports book wagering server or payment disbursement server, etc.) Unless described otherwise, the construction and operation of the various blocks shown in FIG. 2 are of conventional design. As a result, such blocks need not be described in further detail herein, as they will be understood by those skilled in the relevant art.

The sports book wagering computer system 202 may include one or more processing units 212*a*, 212*b* (collectively 212), a system memory 214 and a system bus 216 that couples various system components including the system memory 214 to the processing units 212. The processing units 212 may be any logic processing unit, such as one or more central processing units (CPUs) 212*a*, digital signal processors (DSPs) 212*b*, application-specific integrated circuits (ASICs), field programmable gate arrays (FPGAs), etc. The system bus 216 can employ any known bus structures or architectures, including a memory bus with memory controller, a peripheral bus, and a local bus. The system memory 214 includes read-only memory ("ROM") 218 and random access memory ("RAM") 220. A basic input/output system ("BIOS") 222, which can form part of the ROM 218, contains basic routines that help transfer information between elements within the sports book wagering computer system 202, such as during start-up.

The sports book wagering computer system 202 may include a hard disk drive 224 for reading from and writing to a hard disk 226, an optical disk drive 228 for reading from and writing to removable optical disks 232, and/or a magnetic disk drive 230 for reading from and writing to magnetic disks 234. The optical disk 232 can be a digital video disc ("DVD"), while the magnetic disk 234 can be a magnetic floppy disk or diskette, or other storage medium. The hard disk drive 224, optical disk drive 228 and magnetic disk drive 230 may communicate with the processing unit 212 via the system bus 216. The hard disk drive 224, optical disk drive 228 and magnetic disk drive 230 may include interfaces or controllers (not shown) coupled between such drives and the system bus 216, as is known by those skilled in the relevant art. The drives 224, 228 and 230, and their associated computer-readable storage media 226, 232, 234, may provide nonvolatile and non-transitory storage of computer-readable instructions, data structures, program engines and other data for the sports book wagering computer system 202. Although the depicted sports book wagering computer system 202 is illustrated employing a hard disk 224, optical disk 228 and magnetic disk 230, those skilled in the relevant art will appreciate that other types of computer-readable storage media that can store data accessible by a computer may be employed, such as magnetic cassettes, flash memory, compact discs ("CD"), Bernoulli cartridges, RAMs, ROMs, smart cards, solid state drives, etc.

The sports book wagering computer system 202 may include a network interface 260 operably coupled to the system bus 216. The network interface 260 may, for example, include one or more modems 252 and/or one or more Ethernet cards or other types of communications cards or components 254 for enabling communications via one or more local area networks (LANs) 208 or wide area networks (WANs) 210.

Program engines can be stored in the system memory 214, such as an operating system 236, one or more application programs 238, refund amount determination modules 240, program data 242 and historical analytics modules 244 capable of analyzing historical data of previous sporting events. Application programs 238 may include instructions that cause the processor(s) 212 to accept wagers from and sell sports ticket sell back options to Bettor A computer system 264, Bettor B computer system 266, and/or other bettor computer systems. Application programs 238 and refund amount determination modules 240 may include computer executable instructions and functionality to provide an interface to perform one or more of the following: place sports book wagers, exercise previously selected or purchased sports book sell back options, and determine refund amounts when bettors exercise previously selected or purchased sports book sell back options based on the analysis of historical data of previous sporting events by the historical analytics module. Application programs 238 and refund amount determination modules 240 may deliver such services over the LAN 208 or WAN 210 using one or more, or a combination of one or more network protocols including, but not limited to, hypertext transfer protocol (HTTP), TCP/IP protocol, UDP protocols, and IEEE 802.11 protocol, as well as other telecommunications or computer networking protocols.

Application programs 238 may also include instructions for handling security such as password or other access protection and communications encryption and also enable access and exchange data with sources such as corporate intranets, extranets, or other networks as described below, as well as other server applications on server computing systems such as those discussed further below. In particular, the system memory 214 may include historical analytics modules or programs, for example historical analytics module 244, configured to analyze and perform statistical analyses of previous sporting events with characteristics in common with the current sporting events on which wagers have been placed and for which sports book sell back options have been purchased. For example, these analyses may be based on historical data regarding outcomes of previous sporting events of the same type as the current sporting event at corresponding breaks in play or corresponding intervals in the previous sporting events and other corresponding factors at the corresponding breaks in play or corresponding intervals in the previous sporting events.

While shown in FIG. 2 as being stored in the system memory 214, the operating system 236, application programs 238, refund amount determination modules 240, program data 242 and historical analytics modules 244 can be stored on the hard disk 226 of the hard disk drive 224, the optical disk 232 of the optical disk drive 228 and/or the magnetic disk 234 of the magnetic disk drive 230.

An operator can enter commands and information into the sports book wagering computer system 202 through input devices such as a touch screen or keyboard 246 and/or a pointing device such as a mouse 248, and/or via a graphical user interface. Other input devices can include a microphone, joystick, game pad, tablet, scanner, etc. These and other input devices are connected to one or more of the processing units 212 through an interface 250 such as a serial port interface that couples to the system bus 216, although other interfaces such as a parallel port, a game port or a wireless interface or a universal serial bus ("USB") can be used. A monitor 252 or other display device is coupled to the system bus 216 via a video interface 254, such as a video adapter. The sports book wagering computer system 202 can include other output devices, such as speakers, printers, etc.

The sports book wagering computer system 202 can operate in a networked environment using logical connections to one or more remote computers and/or devices as described above with reference to FIG. 1. For example, the sports book wagering computer system 202 can operate in a networked environment using logical connections to one or more payment disbursement computer systems 262, and to one or more bettor computer systems, for example, Bettor A computer system 264 and/or Bettor B computer system 266. Communications may be via a wired and/or wireless network architecture, for instance, wired and wireless enterprise-wide computer networks, intranets, extranets, and the Internet. Other embodiments may include other types of communications networks including telecommunications networks, cellular networks, paging networks, and other mobile networks.

The payment disbursement computer system 262 may be separate from or integrated with the sports book wagering computer system 202 and may take the form of a conventional mainframe computer, mini-computer, workstation computer, personal computer (desktop or laptop). The payment disbursement computer system 262 may include a processing unit 268, a system memory 269 and a system bus (not shown) that couples various system components including the system memory 269 to the processing unit 268. The payment disbursement computer system 262 will at times be referred to in the singular herein, but this is not intended to limit the embodiments to a single payment disbursement computer system 262 since in typical embodiments, there may be more than one payment disbursement computer system 262 or other device involved. Non-limiting examples of commercially available computer systems include, but are not limited to, an 80x86 or Pentium series microprocessor from Intel Corporation, U.S.A., a PowerPC microprocessor from IBM, a Sparc microprocessor from Sun Microsystems, Inc., a PA-RISC series microprocessor from Hewlett-Packard Company, or a 68xxx series microprocessor from Motorola Corporation.

The processing unit 268 may be any logic processing unit, such as one or more central processing units (CPUs), digital signal processors (DSPs), application-specific integrated circuits (ASICs), field programmable gate arrays (FPGAs), etc. Unless described otherwise, the construction and operation of the various blocks of the payment disbursement computer system 262 shown in FIG. 2 are of conventional design. As a result, such blocks need not be described in further detail herein, as they will be understood by those skilled in the relevant art.

The system bus can employ any known bus structures or architectures, including a memory bus with memory controller, a peripheral bus, and a local bus. The system memory 269 includes read-only memory ("ROM") 270 and random access memory ("RAM") 272. A basic input/output system ("BIOS") 271, which can form part of the ROM 270, contains basic routines that help transfer information between elements within the peripheral computing system 114, such as during start-up.

The payment disbursement computer system 262 may also include one or more media drives 273 (e.g., a hard disk drive, magnetic disk drive, and/or optical disk drive) for reading from and writing to computer-readable storage media 274 (e.g., hard disk, optical disks, and/or magnetic disks). The computer-readable storage media 274 may, for example, take the form of removable media. For example, hard disks may take the form of Winchester drives, optical disks can take the form of DVDs, while magnetic disks can take the form of magnetic floppy disks or diskettes. The media drive(s) 273 communicate with the processing unit 268 via one or more system buses. The media drives 273 may include interfaces or controllers (not shown) coupled between such drives and the system bus, as is known by those skilled in the relevant art. The media drives 273, and their associated computer-readable storage media 274, provide nonvolatile storage of computer-readable instructions, data structures, program engines and other data for the payment disbursement computer system 262. Although described as employing computer-readable storage media 274 such as hard disks, optical disks and magnetic disks, those skilled in the relevant art will appreciate that payment disbursement computer system 262 may employ other types of computer-readable storage media that can store data accessible by a computer, such as magnetic cassettes, flash memory cards, compact discs ("CD"), Bernoulli cartridges, RAMs, ROMs, smart cards, solid state drives, etc.

Program engines, such as an operating system, one or more application programs, other programs or engines and program data, can be stored in the system memory 269. Program engines may include instructions for handling security such as password or other access protection and communications encryption. The system memory 269 may also include communications and server programs, for example a Web server that permits the payment disbursement computer system 262 to disburse and/or initiate disbursement of payments to bettors for winning bets and/or for refunds resulting from the bettor exercising a sports book ticket sell back option (e.g., during a specified break in play during a an event or other indicated period). The other indicated period may be any period from the moment the wager is placed through completion of the entire sporting event or through completion of any portion of the sporting event. The payments may be disbursed directly via a cash dispenser or voucher printer (not shown) connected to or integrated with the payment disbursement computer system 262, or electronically to an account associated with the bettor. The electronic disbursements may be sent over the Internet and/or via Web applications and/or other networks or electronic payment and deposit systems such as automated clearing house (ACH) systems, credit and debit systems, etc, via network 108.

While described as being stored in the system memory 269, the operating system, application programs, other programs/engines, program data and/or browser can be stored on the computer-readable storage media 274 of the media drive(s) 273. An operator can enter commands and information into the payment disbursement computer system 262 via a user interface 275 through input devices such as a touch screen or keyboard 276 and/or a pointing device 277 such as a mouse. Other input devices can include a microphone, joystick, game pad, tablet, scanner (e.g., sports book ticket scanner), etc. These and other input devices are connected to the processing unit 269 through an interface such as a serial port interface that couples to the system bus, although other interfaces such as a parallel port, a game port or a wireless interface or a universal serial bus ("USB") can be used. A display or monitor 278 may be coupled to the system bus via a video interface, such as a video adapter. The Payment disbursement computer system 262 can include other output devices, such as speakers, printers, etc.

The payment disbursement computer system 262 includes instructions stored in non-transitory computer-readable storage media that cause the processor(s) of the payment disbursement computer system 262 to pay bettors bets won that had been placed on sporting events through the sports book wagering computer system 202 from various bettor computer systems over the LAN 208 or WAN 210, including, for example, those from Bettor A computer system 264 and Bettor B computer system 266. For example, the sports book wagering computer system 202 may disburse or initiate disbursement of a ticket (paper or electronic) indicating a wager placed for a bet made on a sporting event by Bettor A.

The payment disbursement computer system 262 also includes instructions stored in non-transitory computer-readable storage media that cause the processor(s) of the payment disbursement computer system 262 to refund bettors amounts determined and communicated by the refund amount determination module 240 of the sports book wagering computer system 202 when the bettor exercises a previously purchased sports book ticket sell back option during a specified break in play or other indicated period of the sporting event on which the original bet was placed. The other indicated period may be any period from the moment the wager is placed through completion of the entire sporting event or through completion of any portion of the sporting event.

For example, Bettor A may have purchased on option to sell back the sports book ticket disbursed by the sports book wagering computer system 202 during half time of the sporting event on which the bet was made for a refund amount determined at the time the option is exercised. In some embodiments, this refund amount may not fall below a guaranteed pre-determined minimum amount. To exercise the purchased option, at some time (e.g., half time, between periods, between innings or quarters) during the sporting event, Bettor A sells back the sports book ticket issued by the sports book wagering computer system 202 by bringing, sending, initiating sending or otherwise communicating the ticket (if electronic) to the payment disbursement computer system 262 to have the ticket electronically scanned or read, have the refund amount determined (either by the sports book wagering computer system 202 or the payment distribution computer system) and receive the determined refund amount. In some embodiments, the payment distribution computer system may wirelessly authenticate the Bettor A computer system 264 (e.g., via a near field communications (NFC) or radio frequency identification (RFID) chip in the Bettor A computer system 264 and/or the payment distribution computer system 262) to enable payment disbursement to Bettor A. Note that although the refund amount determination module 240 and historical analytics module 244 are shown as being part of the sports book wagering computer system 202, one or both of these modules may also or instead be part of the payment disbursement computer system 262.

In instances where the refund amount determination module 240 is part of the payment disbursement computer system 262, the payment disbursement computer system 262 includes instructions stored in non-transitory computer-readable storage media that cause the processor(s) of the payment disbursement computer system 262 to receive additional information and analyses from the sports book wagering computer system 202 regarding historical statistical data of outcomes of previous sporting events of the same type as the current sporting event on which the bet was made and corresponding to the same breaks in play or corresponding intervals in the previous sporting events and other corresponding factors at the same breaks in play or corresponding intervals in the previous sporting events to determine a refund amount.

The Bettor A computer system 264 may have one or more identical or similar components to the previously described computer systems, for example a processing subsystem 280 including one or more non-transitory processor and computer-readable memories, a media subsystem including one or more drives and computer-readable storage media, and one or more user interface subsystems 282 including one or more keyboards, keypads, displays, pointing devices, graphical interfaces, scanners and/or printers.

The Bettor A computer system 264 includes program instructions stored in non-transitory computer-readable storage media such as those program instructions of a Web browser 284 configured to access the services of the sports book wagering computer system 202 and the payment disbursement computer system (e.g. to remotely place wagers on sporting events, purchase sports book ticket sell back options, remotely exercise previously purchased sports book ticket sell back options, collect refunds and payments, etc.). The browser 284 in the depicted embodiment is markup language based, such as Hypertext Markup Language (HTML), Extensible Markup Language (XML) or Wireless Markup Language (WML), and operates with markup languages that use syntactically delimited characters added to the data of a document to represent the structure of the document. A number of Web clients or browsers are commercially available such as those from Mozilla, Google and Microsoft.

The Bettor B computer system 266 may have identical or similar components to the previously described computer systems, for example a processing subsystem 286 including one or more non-transitory processor and computer-readable memories, a media subsystem 288 including one or more drives and computer-readable storage media, and one or more user interface subsystems 290 including one or more keyboards, keypads, displays, pointing devices, graphical interfaces scanners and/or printers.

For example, the Bettor B computer system 266 may include program instructions stored in non-transitory computer-readable storage media such as those program instructions of a Web browser 290 configured to access the services of the sports book wagering computer system 202 similar to that of Web browser 284 of Bettor A computer system 264 described above. Although there are only two example bettor computer systems depicted in FIG. 2, there may be fewer or more such bettor computer systems operably connected to LAN 208 and/or WAN 210 in various other embodiments.

Figure 3:
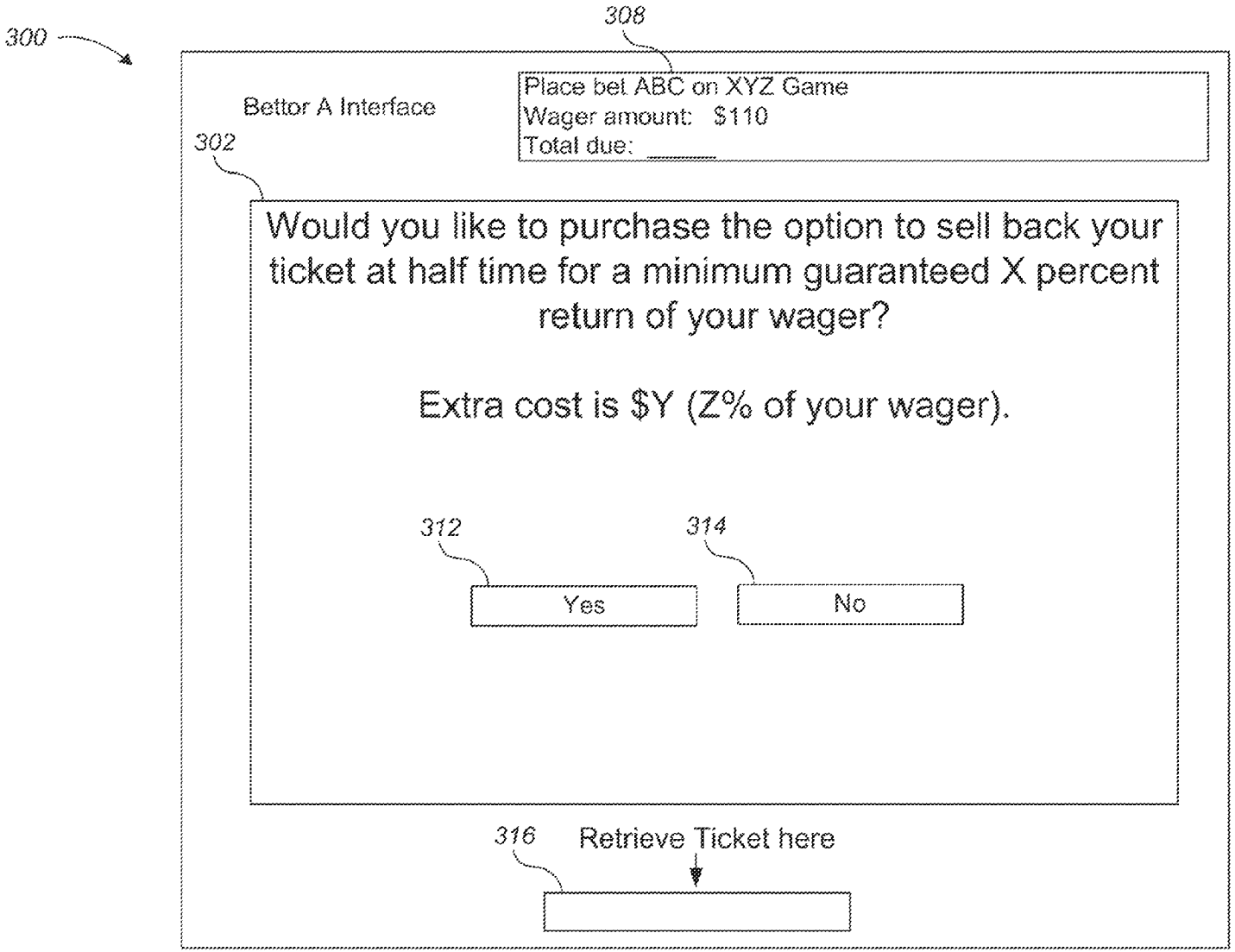
FIG. 3 is a diagram of an example bettor user interface to purchase a sports book wager ticket sell back option, according to one illustrated embodiment.

FIG. 3 is a diagram of an example user interface 300 for Bettor A to purchase a sports book wager ticket sell back option, one or more portions of which may be displayed on a display of the sports book wagering computer system 202 or the Bettor A computer system 264, according to one illustrated embodiment. Bettor A may purchase a sports book ticket sell back option via the interface 300, for example, during the process of placing a wager on the corresponding sporting event. Also, a bettor may purchase a sports book ticket sell back option via the interface 300 after placing a wager on the corresponding sporting event at some time before completion of the specified break in play or indicated period in which the option may be exercised and after having received the sports book ticket indicating the initial wager. There may be some instances after which the sports book ticket has been issued where the purchase of a sell back option is barred or suspended, including, but not limited to: changes in the point spread, key players becoming injured, key players being removed from the roster, catastrophic events for a particular team, etc. The purchased option may be an option to be exercised by the bettor during a specified break in play or indicated period of the corresponding sporting event (e.g., during half time) for the bettor to receive compensation (i.e., a determined refund amount) for canceling the wager.

However, in some embodiments, all or some of the user interface 300 features and components described herein may be configured for the sports book employee or agent to use instead of or in addition to Bettor A, such as to place wagers and make sell back option purchases on behalf of Bettor A. In other embodiments, neither the sports book nor Bettor A need use the Bettor A interface to place the wager and have the sell back option purchased by Bettor A. For example, Bettor A enters a sports book and walks up to the existing counter that is manned by an agent of the sports book. Bettor A then asks to make a wager on any of the types of bets for any of the events offered for wagering by the sports book (e.g., football, basketball, soccer, baseball, boxing, individual competitions, horse racing, political events, competitions, contests, activities of public figures, activities of celebrities, etc.). The types of bets or wagers may include, but are not limited to: straight, total score (i.e., over/under), money line, teasers, future bets, if-win only (single action), if-win-tie-cancel (double action), reverse wagers, buying points, proposition bets, etc. Bettor A then requests that the agent include the sell back option in his wager, or the agent makes a proffer to the bettor and the bettor accepts the proffer from the agent to participate in the sell back option. One or more of the above acts may be performed independently or in conjunction with the Bettor A interface. In one embodiment, where Bettor A declines purchase or selection of the sports book ticket sell back option (or had never been offered the sell back option) and after having been issued the sports book ticket indicating the initial wager, the sports book may make an unsolicited offer to Bettor A for Bettor A to have the opportunity to purchase a sports book ticket sell back option at some time before completion of the break in play or indicated period in which the option may be exercised. The offer to Bettor A may be displayed on a public display in the establishment of the sports book, shown on a display of the Bettor A computer system, printed out and provided to Bettor A, posted on a sports book web site, and/or electronically communicated via email, text message, fax, etc.

An added cost of participating in the sell back option, if any, is determined by the sports book and can range from 0% to any percentage of the ticket price or amount wagered and/or any fixed dollar amount chosen by the sports book. At the discretion of the sports book, an added cost of participating in the sell back option at the time the wager is placed may be higher or lower than an added cost of participating in the sell back option when purchased at a later time.

The refund amount (i.e., the value of the sports book ticket sell back option to Bettor A) may be determined at the time the sports book ticket sell back option is exercised based on a current probability or odds at the specified break in play of the event or indicated period of whether the bettor will win the bet for which the wager was made. The option may also include a minimum guaranteed amount (e.g., 20 percent of the wager amount, or other pre-determined minimum amount) to be refunded to the bettor should the bettor choose to exercise the option. However, in some embodiments, there may be no guaranteed percentage refund or other guaranteed refund amount. The current calculated refund amount (i.e., current value of the sports book ticket sell back option) may be shown to the bettor at the time of the purchase of the sports book ticket sell back option, or at any time from the moment the sporting event begins to (and including) the period when the bettor can exercise the option. For example, this value may be displayed on a public display in the establishment of the sports book, shown on the display 302 of Bettor A Interface, printed out and provided to the bettor, posted on a sports book web site, and/or electronically communicated via email, text message, fax, etc.

In one example embodiment, user interface item 308 of user interface 300 is configured to display an indication of the type of bet placed (e.g., ABC), display an indication of which sporting event on which the bet was placed (e.g., XYZ game) and the wager amount (e.g., $110). Before the ticket is issued, user interface item 302 is configured to display a prompt asking Bettor A whether the Bettor A would like to purchase the sports book ticket sell back option for a minimum guaranteed percent return of the wager amount should the option be exercised by the bettor during the specified break in play. In some embodiments, there may be no minimum guaranteed percentage refund or other guaranteed refund amount. The user interface item 302 also indicates the up-front and non-refundable cost or fee charged to the bettor for the purchase of the option. For example, this fee may be a percentage of the wager (e.g., 2.5 percent of the wager). However, other percentage amounts, flat fees or combinations thereof, may be selectively charged by the sports book wagering computer system and will be indicated to the bettor via the user interface item 302. In some embodiments, the sports book may elect to charge no fee or a refundable fee for the purchase of a sports book ticket sell back option and this will be indicated to the bettor via the user interface item 302.

The user interface item 302 also includes controls selectable by the bettor to indicate whether the bettor wants to purchase the sports book ticket sell back option. For example, the user selects icon or button 312 to indicate the bettor wants to purchase the option and selects icon or button 314 to indicate that the bettor does not want to purchase the option. In embodiments where user interface item 302 is displayed on the sports book wagering computer system 202, the interface 300 may also include a ticket printing and retrieval component 316 configured to print a sports book ticket indicating the wager and whether the sports book ticket sell back option had been purchased. These indications may be printed or otherwise encoded (e.g., on a bar code) on the sports book ticket dispensed by the ticket printing and retrieval component 316.

In other embodiments (e.g., those in which the user interface item 302 is displayed on a Bettor A computer system 264 remote from the sports book wagering computer system 202), the sports book ticket may be issued electronically as an electronic ticket stored on the sports book wagering computer system 202 and/or Bettor A computer system 264. The electronic sports book ticket is associated with the bettor via a code communicated to the bettor via the sports book wagering computer system, an account of the bettor, or other bettor credentials which may be verified at a point when the sports book ticket is used to redeem a payment amount for winning the bet placed or for exercising the purchased sports book ticket sell back option.

In embodiments where Bettor A declines purchase of a sports book ticket sell back option via the interface 300 after placing a wager on the corresponding sporting event at some time before completion of the specified break in play or indicated period in which the option may be exercised and after having been issued the sports book ticket indicating the initial wager, Bettor A may scan the sports book ticket (e.g., via a machine-readable symbol such as barcode or 2-D code symbol, radio frequency identification or RFID transponder, near field communication (NFC) chip, or optical character recognition or OCR) at a scanner that is part of the ticket printing and retrieval component 316 or located elsewhere (such as on the Bettor A computer system 264) to have the sell back option associated with the wager associated with the sports book ticket. In embodiments involving an electronic ticket, Bettor A may input the code provided to Bettor A at the time the ticket was issued or other credentials associated with the electronic ticket or Bettor A in order to have the sell back option associated with the wager indicated by the previously issued sports book ticket.

Figure 4:
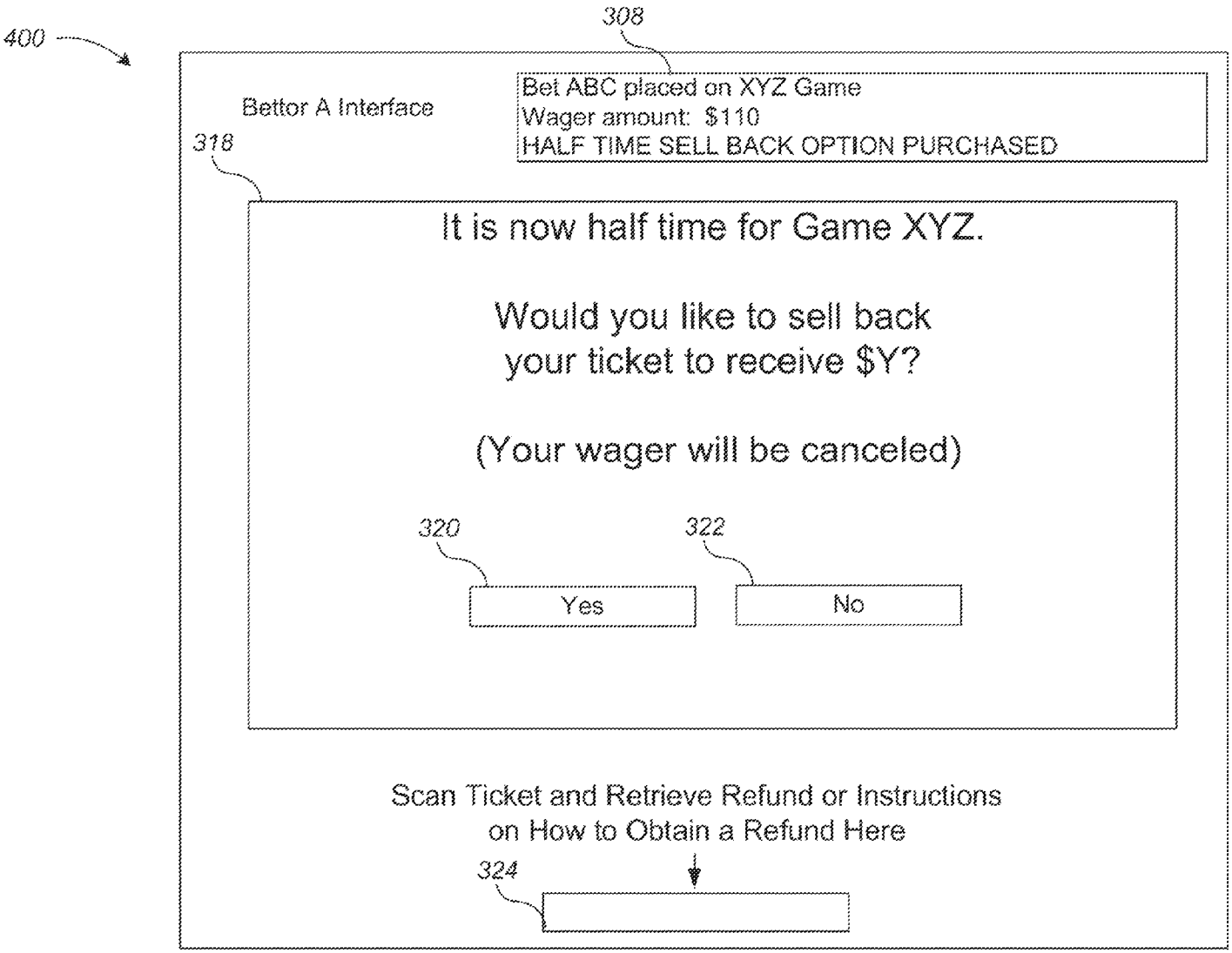
FIG. 4 is a diagram of an example bettor user interface to exercise a sports book wager ticket sell back option, according to one illustrated embodiment.

FIG. 4 is a diagram of an example user interface 400 for facilitating Bettor A to exercise a sports book wager ticket sell back option, one or more portions of which may be displayed on a display of the sports book wagering computer system 202, payment disbursement computer system 262 or the Bettor A computer system 264, according to one illustrated embodiment. Bettor A may exercise a sports book ticket sell back option (such as the one purchased via interface 300 of FIG. 3) via the interface 400 of FIG. 4, for example, during the specified break in play or indicated period during which the previously purchased option is valid.

However, in some embodiments, all or some of the user interface 400 features and components described herein may be configured for the sports book employee, cashier or agent to use instead of or in addition to Bettor A, such as to exercise sell back option purchases on behalf of Bettor A and provide refunds to Bettor A. In other embodiments, neither the sports book nor Bettor A need use the user interface 400 to exercise the sports book ticket sell back option. For example, Bettor A may approach a sports book cashier, ask to exercise the sports book sell back option, hand the cashier the sports book ticket, and the cashier will provide the refund amount in cash to Bettor A. If Bettor A chooses to exercise the sports book ticket sell back option, Bettor A can make it known to the sports book via any system that the sports book cares to use, whether it be electronic or open utterance. For example, Bettor A can scan or insert the sports book ticket, or input information related to the sports book ticket, into an electronic kiosk, approach a sports book agent at the counter of the sports book or enter a code or scan the sports book ticket using an electronic handheld device, etc. However, with respect to Bettor A, such a kiosk, sports book agent and/or handheld device may use any combination of features and components described herein of the user interfaces 300 and 400, the sports book wagering system 202, payment disbursement computer system 262 and/or the Bettor A computer system to perform the sports book ticket sell back option purchase, exercise the sports book ticket sell back option, determine the sports book ticket refund amount and/or to disburse the refund amount.

The period in which the sports book ticket sell back option may be exercised may be during all or a portion of any number of periods during the sporting event as determined by the sports book. For example, sports book ticket sell back options may be exercised during a single specific break in play, multiple specific breaks in play or any break in play. A break in play is defined as stoppage in play for any reason whatsoever and may include, but is not limited to the following breaks in play during various sporting events: half time period, quarter periods, between innings or half-innings in baseball games, time-outs, between regulation time and overtime periods, during caution laps of an auto race, the period intermission of a hockey game, between rounds of a boxing match, prior to specific types of plays (e.g., field goals, two-point conversions, penalty kicks or shots), a period prior to a specific event that might occur during the course of play including but not limited to: an injury to a player, removal of a pitcher, or changing of a goaltender. In some embodiments, the sports book may determine that sports book ticket sell back options may be exercised from the moment the wager is recorded through completion of one of: a portion of the sporting event or the entirety of the sporting event. This is defined as an indicated period and may be communicated to the bettor at the time of placement of the wager. In one embodiment, sports book ticket sell back options may be exercised during both ongoing play as well as all breaks in play during the indicated period.

For example, during half time of a sporting event for which Bettor A has placed a wager and purchased a half time sports book ticket sell back option, Bettor A may approach the sports book wagering computer system 202, approach a cashier, employee or other agent using the sports book wagering computer system 202, or utilize the Bettor A computer system 264 to exercise the option. The bettor may scan their sports book ticket at the component 324 on the sports book wagering computer system 202 that is configured to scan and read information encoded in machine-readable symbols on or RFID transponders on or in the sports book ticket. Component 324 may then print out a voucher or coupon that the bettor may redeem for cash, or in some alternative embodiments, dispense cash. In other embodiments, instead of receiving a voucher or cash, the bettor may receive instructions at or via component 324 on how to obtain a refund. For example, component 324 may print, display or otherwise communicate instructions for the bettor on how, when and where to proceed to a cashier, refund machine, etc. with the ticket to complete the refund process. Component 324 may also communicate a refund code or other item to use alone or in conjunction with the ticket to enable the bettor to receive the refund or initiate an electronic transaction to credit an account of the bettor to provide the refund.

In some embodiments, where the sports book ticket is an electronic ticket, Bettor A may provide a code associated with the electronic ticket given to the Bettor at the time the ticket was issued, or input credentials associated with Bettor A and/or the issued electronic ticket at the sports book wagering computer system 202 or the Bettor A computer system 264. User Interface item 318 may then be displayed to Bettor A including a prompt asking Bettor A whether Bettor A would like to exercise the sports book ticket sell back option purchased for that sports book ticket. User Interface item 318 also displays the refund amount (i.e., the value of the sports book ticket sell back option to Bettor A). User interface item 308 of user interface 400 is also configured to display an indication of the type of bet placed (e.g., ABC), display an indication of which sporting event on which the bet was placed (e.g., XYZ game) and the wager amount (e.g., $110).

The user interface item 318 also includes controls (e.g., user selectable icons, dialog boxes, keys, switches, buttons) selectable by the bettor to indicate whether the bettor wants to exercise the sports book ticket sell back option. For example, the user selects icon or button 320 to indicate the bettor wants to exercise the option and selects icon or button 322 to indicate that the bettor does not want to exercise the option. If Bettor A selects icon or button 320 to indicate the Bettor A wants to exercise the option, then a refund amount will be dispensed, sent or otherwise issued to Bettor A.

As mentioned above, the refund amount (i.e., the value of the sports book ticket sell back option to Bettor A) may be determined at the time the sports book ticket sell back option is exercised based on a current probability or odds at the specified break in play or indicated period of the sporting event of whether the bettor will win the bet for which the wager was made. The option may also include a minimum guaranteed amount (e.g., 20 percent of the wager amount, or other pre-determined minimum amount) to be refunded to the bettor should the bettor choose to exercise the option. However, in some embodiments, there may be no guaranteed percentage refund or other guaranteed refund amount. The current calculated refund amount (i.e., current value of the sports book ticket sell back option) may be shown to the bettor at the time of the purchase of the sports book ticket sell back option, or at any time from the moment the wager is placed to (and including) the period when the bettor can exercise the option. For example, this value may be displayed on a public display in the establishment of the sports book, shown on the display 318 of Bettor A Interface, printed out and provided to the bettor, posted on a sports book web site, and/or electronically communicated via email, text message, fax, etc. In some embodiments, Bettor A may approach and/or activate user interface 400 and scan or otherwise input the bettor's ticket or ticket information for the user interface 400 to display the current refund amount (i.e., the value of the sports book ticket sell back option to Bettor A).

The current refund amount (i.e., the value of the sports book ticket sell back option to Bettor A) can be determined in any manner that the sports book chooses. The sports book may use a historical probability model, a coin toss or whatever system or method they choose. In some circumstances, the sports book may choose to outsource determination of the current refund amount to an individual or entity deemed to have special expertise in the regard. Even when outsourced, the sports book retains ultimate authority to determine the current refund amount.

The determined refund amount may be based on statistical analyses of previous sporting events with characteristics in common with the current sporting events on which wagers have been placed and for which sports book sell back options have been purchased and, in some embodiments, based on intrinsic game factors. These intrinsic game factors may include, but are not limited to, catastrophic player injury, illness or other disqualification occurring before the specified break in play or before completion of the indicated period during which the sports book ticket sell back option may be exercised. In some embodiments, these analyses may be based on historical data regarding outcomes of previous sporting events of the same type as the current sporting event at corresponding breaks in play or corresponding intervals in the previous sporting events and other corresponding factors at the corresponding breaks in play or corresponding intervals in the previous sporting events.

For example, if Bettor A placed a wager of $110 on the Bears playing the Packers (the home team) that the Packers would not win by more than 7 points, and at half time the score is Bears 10 and Packers 17, then the analysis would determine the percentage probability (based on historical NFL statistical data) that a home team winning by 7 points at half time gains at least one point in the second half. The sports book wagering computer system 202 or payment disbursement computer system 262 would then use this probability to determine the amount to refund Bettor A at half time for exercising the sports book ticket sell back option. The percentage amount refunded may also be reduced further (e.g., by one percentage point) as an additional charge to the bettor and would thus increase the amount earned by the sports book organization (i.e., the vigorish). Using the present example, if the probability that a home team winning by 7 points at half time gains at least one point in the second half is 75 percent and the sports book organization reduces the percentage or odds paid to the bettor, e.g., by one percentage point, then the amount refunded Bettor A should Bettor A exercise the sell back option would be (25%−1%)*$210=$50.40. However, in other examples using the same wager amount, based on the probability and the additional percentage charged by the sports book organization, if the determined amount to refund falls below the guaranteed refund amount (e.g., falls below 20 percent of the wager amount), the amount refunded would instead be the guaranteed refund amount of 20 percent of the wager amount ($22).

In some embodiments, the determined amount to refund the bettor when the bettor exercises the sports book ticket sell back option may also be based on or adjusted according to the current number of sports book ticket sell back options being exercised for a particular winning or losing team during previous breaks in play and/or the current specified break in play or indicted period to keep a more even amount of sports book ticket sell back options being exercised for each team of the sporting event. For example, if the current number or dollar value of sell back options being exercised for team A of the sporting event far outweighs that of team B of the sporting event, then the determined amount to be refunded for exercising sports book ticket sell back options for team A may be reduced and/or the determined amount to be refunded for exercising sports book ticket sell back option for team B may be increased.

Figure 5:
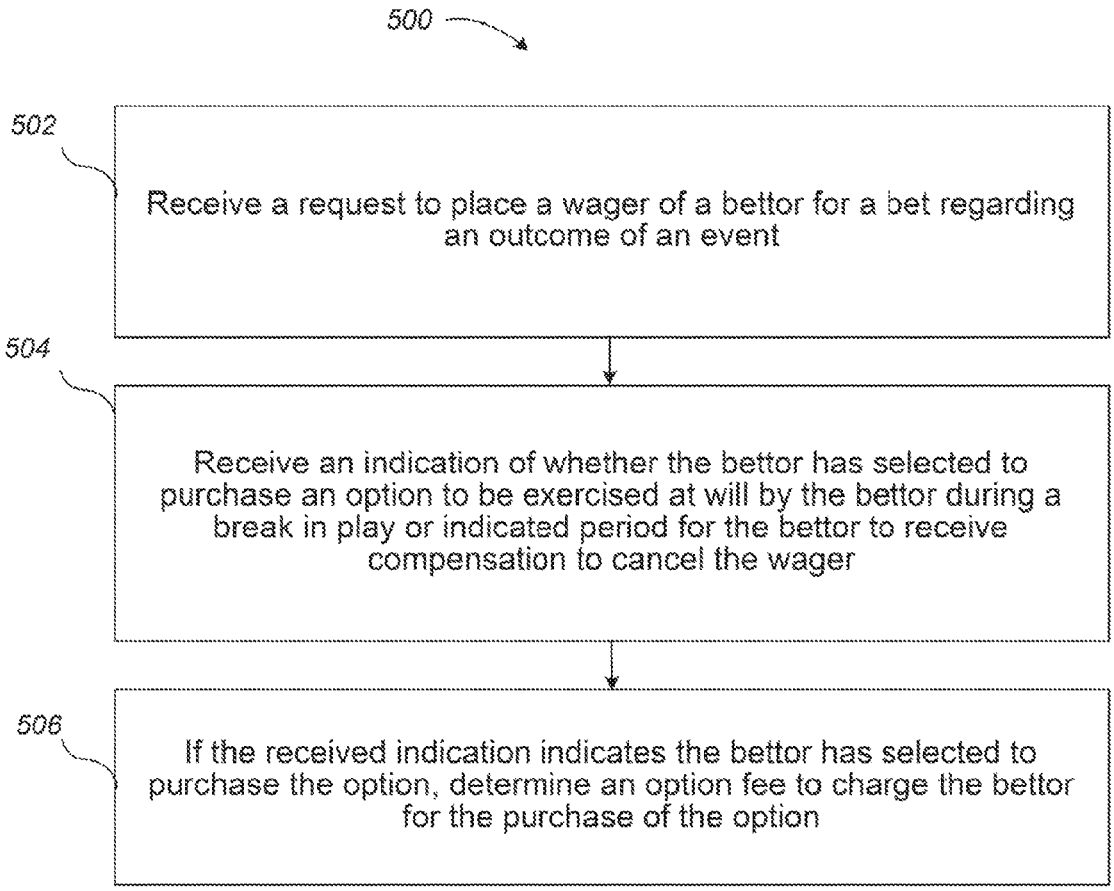
FIG. 5 is a flow diagram showing a method of electronically processing a request to purchase a sports book wager ticket sell back option, according to one illustrated embodiment.

FIG. 5 shows a method 500 for electronically processing a request to purchase a sports book wager ticket sell back option, according to one illustrated embodiment. In some embodiments, the bettor may communicate the request for a wager in any manner to a designated agent of the sports book. The agent may then enter the wager into the sports book wagering computer system 202.

The method 500 starts at 502, in which the sports book wagering computer system 202 shown in FIG. 2 receives a request to place a wager of a bettor for a bet regarding an outcome of an event.

At 504, the sports book wagering computer system 202, receives an indication of whether the bettor has selected to purchase an option to be exercised at will by the bettor during a break in play or an indicated period for the bettor to receive compensation to cancel the wager.

At 506, if the received indication indicates the bettor has selected to purchase the option, the sports book wagering computer system 202 determines an option fee to charge the bettor for the purchase of the option.

Also, in some embodiments, a sports ticket sell back option may automatically be sold or included as part of the bet placed by the bettor, and the bettor automatically charged without prompting the bettor to indicate whether the bettor desires to purchase the sports book ticket sell back option.

Figure 6:
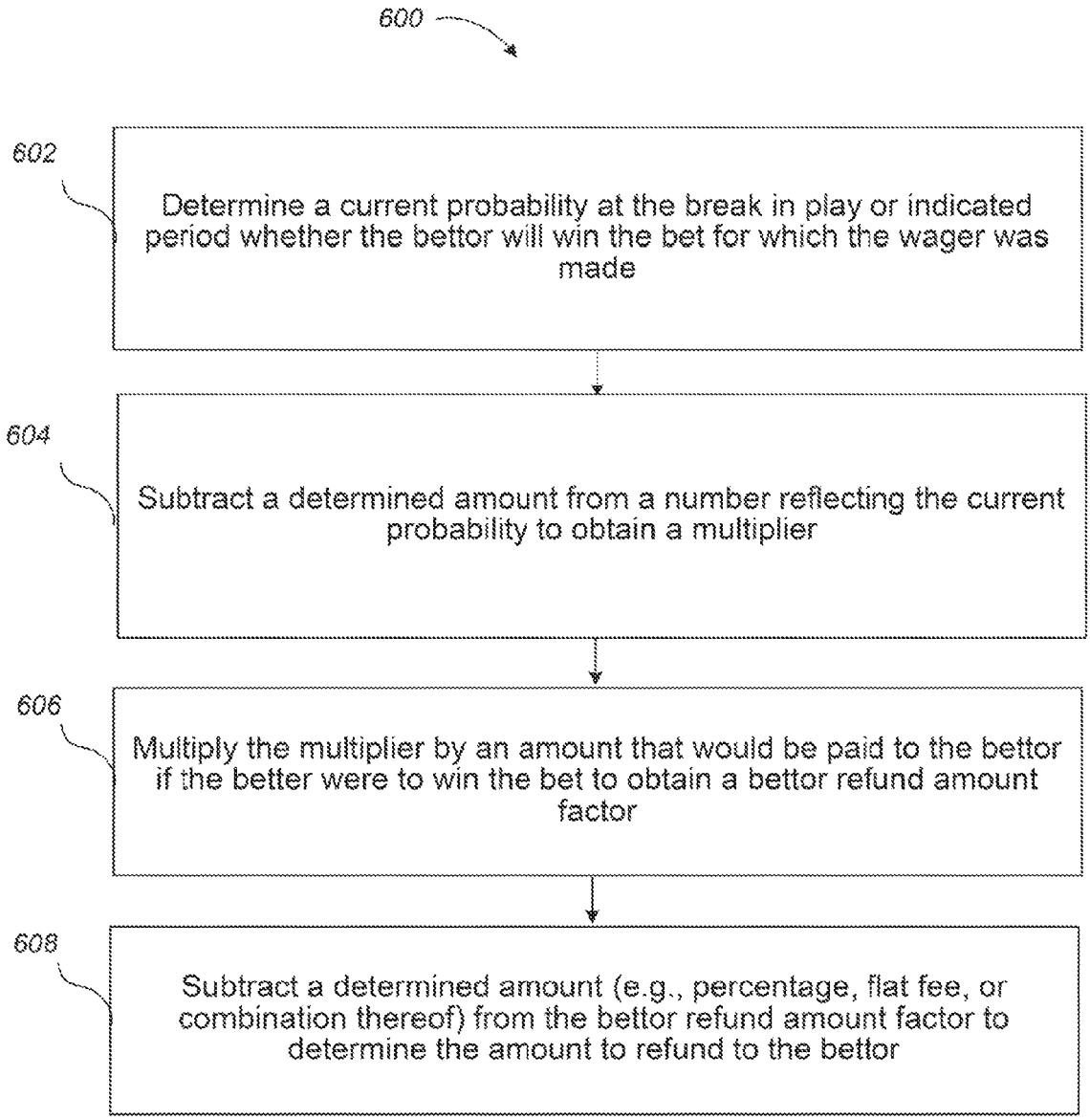
FIG. 6 is a flow diagram showing a method of electronically determining an amount to refund a bettor who is exercising a sports book wager ticket sell back option previously purchased by the bettor that is useful in the method of FIG. 5, according to one illustrated embodiment.

FIG. 6 shows a method 600 for electronically determining an amount to refund a bettor who is exercising a sports book wager ticket sell back option previously purchased by the bettor that is useful in the method of FIG. 5, according to one illustrated embodiment. For example, during the specified break in play during the sporting event, or in some embodiments, during any time from the point the wager is placed until the sporting event ends, the sports book wagering computer system 202 may receive an indication that the bettor is exercising the purchased option and in response to the received indication that the bettor is exercising the purchased option, the sports book wagering computer system 202 determines an amount to refund to the bettor according to the method 600. Although the method 600 described below includes determining an amount to refund to the bettor based on a probability of whether the bettor will win the bet for which the wager was made, the amount to refund to the bettor may be based on anything. For example the amount to refund to the bettor may be based on, including but not limited to: a probabilistic method, a random method, recommendation from an individual or entity, voting, a static amount, etc. In various embodiments, the amount to refund to the bettor may be any percentage of the original bet made by the bettor, a flat amount, or any combination thereof.

The method 600 starts at 602, in which the sports book wagering computer system 202 shown in FIG. 2 determines a current probability (e.g., percentage probability) at the break in play or the indicated period of whether the bettor will win the bet for which the wager was made.

At 604, the sports book wagering computer system 202 subtracts a determined amount (e.g., percentage, flat fee, or combination thereof) from a number reflecting the current probability (e.g., percentage probability) to obtain a multiplier.

At 606, the sports book wagering computer system 202 multiplies the multiplier by an amount that would be paid to the bettor if the bettor were to win the bet to obtain a bettor refund amount factor.

At 608 the sports book wagering computer system 202 subtracts a determined amount (e.g., percentage, flat fee, or combination thereof) from the bettor refund amount factor to determine the amount to refund to the bettor.

The method may further include varying the determined amount to refund to the bettor during the sporting event before the specified break in play or the indicated period, or at any time before the event on which the wager was placed ends, the varying of the determined amount being indicated by the electronic sports book wagering system.

The method may further include communicating the varied determined amount to the bettor in response to the varying of the determined amount.

For example, the method may include communicating the determined amount to the bettor at any point from a time ranging from the moment the wager is recorded to a point during the break in play or the indicated period during the sporting event. The receiving an indication that a bettor intends to exercise the option may include receiving the indication that the bettor intends to exercise the purchased option during the break in play or the indicated period during the sporting event.

The method may further include communicating the determined amount to the bettor in response to the received indication that the bettor intends to exercise the purchased option.

The up-front and non-refundable cost or fees charged to the bettor for the purchase of the sell back option as well as the fees charged at 604 and 608 are determined by the sports book. Such fees may vary depending, for example, on the individual sporting event, type of wager, or even from time to time (e.g., the day of the week the wager is placed and/or the day of the week the sporting event occurs). At the discretion of the sports book, some or all of the fees may be waived as a means of increasing current bettor's interest and attracting new bettors. In addition to the waiving of fees, the sports book may incentivize the purchase and/or redemption of sports book ticket sell back options by offering casino compensation ("comps") including but not limited to: free or discounted hotel room stays, show tickets, meals, drinks, gift certificates, etc.

Figure 7:
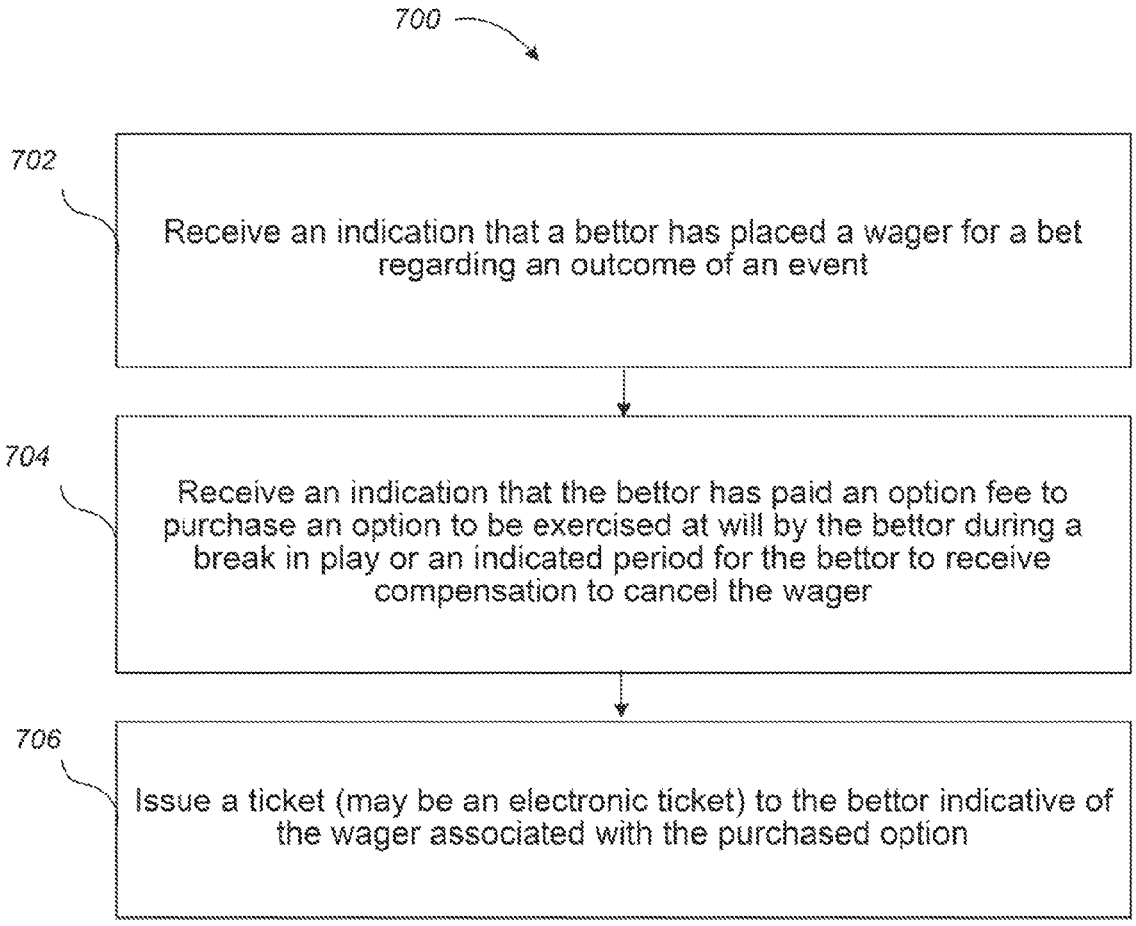
FIG. 7 is a flow diagram showing a method of electronically issuing a ticket indicative of a wager associated with a sports book wager ticket sell back option, according to one illustrated embodiment.

FIG. 7 shows a method 700 for electronically issuing a ticket indicative of a wager associated with a sports book wager ticket sell back option, according to one illustrated embodiment.

The method 700 starts at 702, in which the sports book wagering computer system 202 shown in FIG. 2 receives an indication that a bettor has placed a wager for a bet regarding an outcome of an event.

At 704, the sports book wagering computer system 202 receives an indication that the bettor has paid an option fee to purchase an option to be exercised at will by the bettor during a break in play or an indicated period, for the bettor to receive compensation to cancel the wager.

At 706, the sports book wagering computer system 202 issues a ticket to the bettor indicative of the wager associated with the purchased option. As mentioned above the sports book ticket may be an electronic ticket that is issued electronically such as by providing a code to the bettor associated with the electronic ticket or associating the issued electronic ticket with a bettor account or other bettor credentials.

Figure 8:
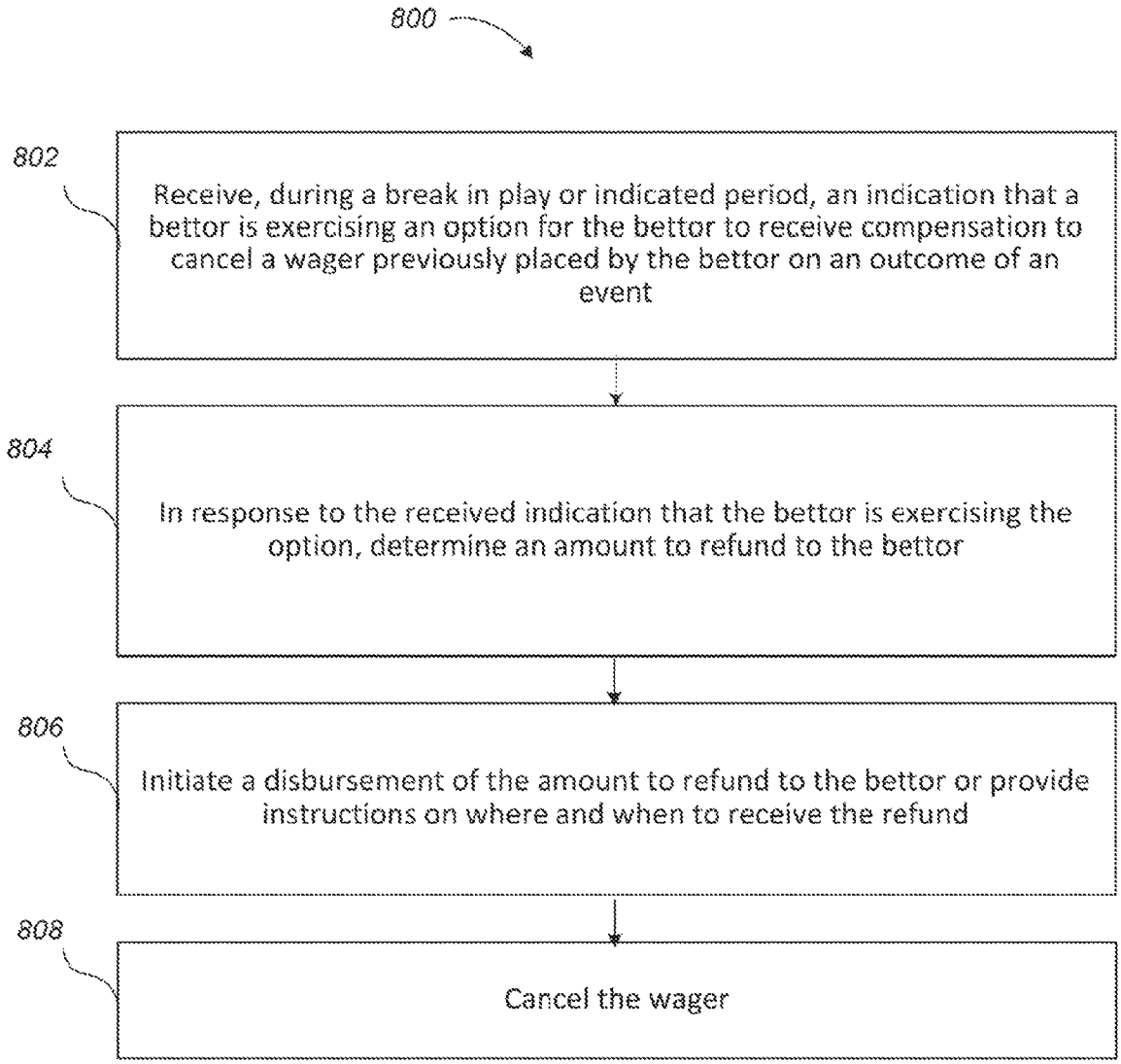
FIG. 8 is a flow diagram showing a method of electronically initiating payment to a bettor who is exercising a sports book wager ticket sell back option previously purchased by the bettor, according to one illustrated embodiment.

FIG. 8 shows a method 800 for electronically initiating payment to a bettor who is exercising a sports book wager ticket sell back option previously purchased by the bettor, according to one illustrated embodiment.

The method 800 starts at 802, in which the sports book wagering computer system 202 or the payment disbursement computer system 262 shown in FIG. 2 receives, during a break in play or an indicated period, an indication that a bettor is exercising an option for the bettor to receive compensation to cancel a wager previously placed by the bettor on an outcome of an event.

At 804, the sports book wagering computer system 202 or the payment disbursement computer system 262, in response to the received indication that the bettor is exercising the option, determines an amount to refund to the bettor.

At 806, the sports book wagering computer system 202 or the payment disbursement computer system 262 initiates a disbursement of the amount to refund to the bettor. The refund to the bettor may be paid in currency or in the form of a credit or any item that has a value to the bettor, including casino compensation ("comps"), including, but not limited to: free or discounted hotel room stays, show tickets, meals, drinks, gift certificates, etc.

At 806, the sports book wagering computer system 202 or the payment disbursement computer system 262 then cancels the wager. For example, the wager may be removed from the sports book wagering computer system 202 or otherwise indicated by the sports book wagering computer system 202 as being canceled, invalid or no longer in effect.

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other systems, not necessarily the exemplary sports book wagering computer system described above. In some embodiments, one or more of the payment disbursement computer systems and the sports book wagering computer system may be one system or controlled by one entity. Also, in some embodiments, the features and functionality described above may be implemented on one stand-alone system.

For instance, the foregoing detailed description has set forth various embodiments of the devices and/or processes via the use of block diagrams, schematics, and examples. Insofar as such block diagrams, schematics, and examples contain one or more functions and/or operations, it will be understood by those skilled in the art that each function and/or operation within such block diagrams, flowcharts, or examples can be implemented, individually and/or collectively, by a wide range of hardware, software, firmware, or virtually any combination thereof. In one embodiment, the present subject matter may be implemented via Application Specific Integrated Circuits (ASICs). However, those skilled in the art will recognize that the embodiments disclosed herein, in whole or in part, can be equivalently implemented in standard integrated circuits, as one or more computer programs running on one or more computers (e.g., as one or more programs running on one or more computer systems), as one or more programs running on one or more controllers (e.g., microcontrollers) as one or more programs running on one or more processors (e.g., microprocessors), as firmware, or as virtually any combination thereof, and that designing the circuitry and/or writing the code for the software and or firmware would be well within the skill of one of ordinary skill in the art in light of this disclosure.

In addition, those skilled in the art will appreciate that the mechanisms taught herein are capable of being distributed as a program product in a variety of forms, and that an illustrative embodiment applies equally regardless of the particular type of signal bearing media used to actually carry out the distribution. Examples of signal bearing media include, but are not limited to, the following: recordable type media such as portable disks and memory, hard disk drives, DVDs, CD ROMs, digital tape, and computer memory; and other non-transitory computer-readable storage media.

The various embodiments described above can be combined to provide further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of operating an electronic sports book wagering system including at least one processor and at least one non-transitory computer-readable medium coupled to the at least one processor, the method comprising:

receiving, by the at least one processor, a request to place a wager of a bettor for a bet regarding an outcome of an event;

receiving an indication that the bettor has placed the wager;

receiving an indication, by the at least one processor, that the bettor has selected to purchase an option to be exercised at will by the bettor during a break in play or indicated period for the bettor to potentially receive compensation to cancel the wager; and based on the received indication that the bettor has selected to purchase the option, calculating, by the at least one processor, an option fee to charge the bettor for the purchase of the option;

receiving an indication that the bettor has paid an option fee;

recording the wager and associating the wager with the purchased option;

during the break in play or the indicated period, receiving an indication that the bettor is exercising the purchased option;

in response to the received indication that the bettor is exercising the purchased option, determining, by the at least one processor, an amount to refund to the bettor, wherein the determining the amount to refund to the bettor includes:

determining a number reflecting a current probability at the break in play or indicated period of whether the bettor will win the bet for which the wager was made;

to obtain a bettor refund amount factor, multiplying the number reflecting the current probability by an amount that would be paid to the bettor if the bettor were to win the bet; and subtracting a determined amount from the bettor refund amount factor in determining the amount to refund to the bettor;

initiating a disbursement of the amount to refund to the bettor; and canceling the wager.

2. The method of claim 1 further comprising:

issuing a ticket to the bettor indicative of the wager associated with the purchased option.

3. The method of claim 1 further comprising:

subtracting a determined amount from the number reflecting the current probability before the multiplying the number reflecting the current probability.

4. The method of claim 1 wherein the determined amount to refund to the bettor is the refund amount factor less any associated fees.

5. The method of claim 1 wherein the determining a current probability at the break in play or indicated period of whether the bettor will win the bet for which the wager was made includes determining the probability based on historical data regarding outcomes of previous events of a same type as the event.

6. The method of claim 5 wherein the historical data includes data based on at least one of: same team scores, same score spread, and same home and away team combination taking into account a current score at a corresponding break in play or corresponding interval of the indicated period in previous events.

7. The method of claim 1 wherein the determining the amount to refund to the bettor further includes determining the amount to refund to the bettor based on a minimum refund amount guaranteed at a time when the purchased option was purchased, should the bettor choose to exercise the purchased option, wherein the minimum refund amount guaranteed is a percentage of the wager;

initiating a disbursement of the amount to refund to the bettor; and canceling the wager.

8. An electronic sports book wagering system, comprising:

at least one processor;

at least one processor-readable memory that stores instructions executable by the at least one processor to cause the at least one processor to:

receive an indication that a bettor has placed a wager for a bet regarding an outcome of an event;

receive an indication that the bettor has selected an option to be exercised at will by the bettor during a break in play or an indicated period for the bettor to potentially receive compensation to cancel the wager;

generate a ticket for the bettor indicative of the wager associated with the option;

during the break in play or the indicated period, receive an indication that the bettor is exercising the option;

in response to the received indication that the bettor is exercising the option, determine an amount to refund to the bettor, wherein the determining the amount to refund to the bettor includes:

determining a current probability at the break in play or the indicated period of whether the bettor will win the bet for which the wager was made based on historical data regarding outcomes of previous events of a same type as the event;

multiplying the determined current probability by an amount that would be paid to the bettor if the bettor were to win the bet to obtain a bettor refund amount factor; and determining the amount to refund to the bettor based on the bettor refund amount factor;

initiate a disbursement of the amount to refund to the bettor; and cancel the wager.

9. The electronic sports book wagering system of claim 8 wherein the break in play is one of: a half time period, a quarter period, a period between innings or half-innings in a baseball game, a time-out, a period between regulation time and an overtime period, a period during caution laps of an auto race, a period intermission of a hockey game, a period between rounds of a boxing match, a period prior to specific types of plays, a period prior to a specific event that potentially could occur during a course of play, including one or more of: an injury to a player, removal of a pitcher and changing of a goaltender.

10. The electronic sports book wagering system of claim 9 wherein the indicated period is an elapsed time from a moment the wager is placed through a completion of one of: a portion of the event and the entirety of the event.

11. The electronic sports book wagering system of claim 8 wherein the ticket is an electronic ticket.

12. A non-transitory computer-readable medium that stores instructions that when executed by at least one computer system cause the at least one computer system to:

receive, during a break in play or an indicated period, an indication that a bettor is exercising an option for the bettor to potentially receive compensation to cancel a wager previously placed by the bettor on an outcome of an event;

in response to the received indication that the bettor is exercising the option, determine an amount to refund to the bettor, wherein the determining the amount to refund to the bettor includes:

determining a number reflecting a current probability at the break in play or indicated period of whether the bettor will win the bet for which the wager was made;

to obtaining a bettor refund amount factor, multiply the number reflecting the current probability by an amount that would be paid to the bettor if the bettor were to win the bet; and subtracting a determined amount from the bettor refund amount factor in determining the amount to refund to the bettor;

initiate a disbursement of the amount to refund to the bettor; and cancel the wager.

13. The non-transitory computer-readable medium of claim 12 wherein the instructions further cause the at least one computer system to determine an option fee to charge the bettor for a selection of the option.

14. The non-transitory computer-readable medium of claim 13 wherein the option fee is in the range from 0% to 99% of an amount of the wager.

15. The non-transitory computer-readable medium of claim 13 wherein the option fee is one or a combination of the following: a flat fee and a percentage of the wager.

16. The non-transitory computer-readable medium of claim 12 wherein the instructions further cause the at least one computer system to communicate the determined amount to the bettor.

17. The non-transitory computer-readable medium of claim 12 wherein the disbursement of the amount to refund to the bettor is an electronic disbursement.

18. The non-transitory computer-readable medium of claim 12 wherein the determining the amount to refund to the bettor includes determining the probability of whether the bettor will win the bet for which the wager was made based on historical data regarding outcomes of previous events.

* * * * *